US007044040B1

(12) United States Patent
Smith

(10) Patent No.: US 7,044,040 B1
(45) Date of Patent: May 16, 2006

(54) LEADING AND TRAILING EDGE STITCH TAB SCRAP STRIPPERS

(75) Inventor: Richard W. Smith, Salem, OH (US)

(73) Assignee: Sebring Container Corporation, Salem, OH (US)

( * ) Notice: Subject to any disclaimer, the term of this patent is extended or adjusted under 35 U.S.C. 154(b) by 129 days.

(21) Appl. No.: 10/810,806

(22) Filed: Mar. 29, 2004

Related U.S. Application Data

(60) Provisional application No. 60/457,590, filed on Mar. 27, 2003.

(51) Int. Cl.
*B26D 7/18* (2006.01)

(52) U.S. Cl. ..... 83/115; 83/117; 83/119; 493/342; 493/472

(58) Field of Classification Search ..... 83/115, 83/118, 119, 125, 128, 120, 653, 123, 124, 83/126, 127; 493/342, 373, 472
See application file for complete search history.

(56) References Cited

U.S. PATENT DOCUMENTS 1,108,898 A * 9/1914 Garratt ..... 72/427
1,751,562 A 3/1930 Stinger
3,499,370 A * 3/1970 Kulwicki et al. ..... 493/342
4,295,842 A * 10/1981 Bell ..... 493/342
4,367,069 A * 1/1983 Bishop ..... 493/342
5,087,237 A 2/1992 Nunley
5,108,358 A 4/1992 Mounce
5,111,725 A * 5/1992 Simpson et al. ..... 83/117
5,300,009 A 4/1994 Bittenbender
5,363,728 A * 11/1994 Elsner et al. ..... 83/23
5,605,527 A 2/1997 Gillieron
5,697,878 A 12/1997 Elkis

* cited by examiner

*Primary Examiner*—Allan N. Shoap
*Assistant Examiner*—Edward Landrum
(74) *Attorney, Agent, or Firm*—Jones Tullar & Cooper PC

(57) ABSTRACT

Leading and trailing edge stitch tab scrap strippers utilize pivot arms which are secured to die block bodies for pivotable motion intermediate their two ends. One end of each arm is adapted to engage a stitch tab scrap portion to be stripped and to effect the removal of the tab scrap from a box blank from which it has been cut. A biasing force is applied against a second end of the pivot arm. The pivot arm is caused to pivot in response to the rotation of an upper male slotting head and a lower die cutting anvil. This pivotal movement is effective to strip or to eject the severed stitch tab scrap.

20 Claims, 11 Drawing Sheets

LEADING AND TRAILING EDGE STITCH TAB SCRAP STRIPPERS

CROSS-REFERENCE TO RELATED APPLICATIONS

The subject U.S. patent application claims priority to U.S. provisional patent application No. 60/457,590, filed Mar. 27, 2003. The specification of that provisional patent application is incorporated herein by reference.

FIELD OF THE INVENTION

The present invention is directed generally to a stitch tab scrap stripper. More particularly, the present invention is directed to leading and trailing edge stitch tab scrap strippers. Most specifically, the present invention is directed to leading and trailing edge stitch tab scrap strippers for use with a corrugated paperboard box blank machine. During a stitch tab cutting process, scraps of corrugated paper are cut from the leading and trailing edges of corrugated paperboard box blanks. These stitch tab scraps must be separated from the box blanks before the box blanks are further processed. The leading and trailing edge stitch tab scrap strippers, in accordance with the present invention, utilize pivotable, biased stripping arms to strip the stitch tab scraps that have been severed by cutting dies. The stitch tab scrap strippers are securable onto die blocks which are attached to a male slotter head which is mounted on an upper male slotter shaft and which is cooperating with a lower cutting die anvil mounted on a lower slotter shaft.

BACKGROUND OF THE INVENTION

A great number of products are packaged, by their manufacturers, for shipping and distribution in corrugated paperboard cartons or boxes. These corrugated paperboard boxes or cartons are typically supplied to their end user; i.e. the manufacturer of the products to be boxed and shipped, in a non-erected configuration. Clearly, it is not efficient to ship or transport fully set up or erected empty paperboard boxes from the box manufacturer to a product manufacturer, who will then fill these erected corrugated paperboard cartons with his product. Rather, these corrugated paperboard cartons are shipped to the end user in a non-erected configuration. The corrugated paperboard boxes arrive at the end user's facility each folded flat as a sleeve. Each carton's bottom and top flaps are usually then folded into place and glued or taped to complete the erection of the cartons immediately before their usage. These non-erected boxes are supplied to the end user by a corrugated box manufacturer.

The corrugated box manufacturer starts with a stack of sheets of corrugated paperboard which he obtains from a supplier of corrugated sheets. The overall size of each sheet has been determined by the box manufacturer or by the end user in accordance with the size of the intended corrugated box or carton. The corrugated paperboard sheets are received by the corrugated box manufacturer from the corrugated sheet supplier typically already provided with cross-corrugation score lines. These score lines will, when combined with score lines added by the corrugated box manufacturer, define lines of fold that will typically cooperate with slots cut into the corrugated sheets by the box manufacturer. In some situations, the corrugated sheets received from the supplier are not scored. In those instances, the box manufacturer must score, slot and print the corrugated sheets.

The corrugated sheets are slotted to create the carton's side panels and end flaps, and may also be printed with suitable graphics, as determined by the end user. A machine, typically referred to as a printer-slotter is used for this purpose. The printer-slotter is akin to a rotary printing press and includes one or more printing cylinders with the number of printing cylinders being equal to the number of colors that can be printed. The printer-slotter also is provided with multiple pairs of cooperating scoring heads and slotting knives.

Once the corrugated sheets have been scored, typically with the scores being arranged extending in a direction of travel of the corrugated sheets through the printer-slotter, they are forwarded along to slotting rollers which include a stitch tab cutting device that is configured with stitch tab cutting die blocks mounted on an upper male slotter head and which cooperate with a lower die cutting anvil. When a typical box blank is formed into a sleeve, at least one of its side edges is configured with a stitch tab. This stitch tab is an elongated flap on one of the side edges of the box blank, intermediate its leading and trailing edges, which stitch tab receives a suitable glue or adhesive prior to the box blank being folded about one of the previously formed, longitudinally extending score lines. Once the box blank has been so folded, to form a sleeve, the stitch or glue tab is utilized to join the side edges of the corrugated paperboard box blank together.

Leading and trailing stitch tab scraps are the portions of the corrugated paperboard box blank which are separated from the scored and slotted box blank during the passage of the scored and slotted box blank between the pair of stitch tab die cutting blocks and the cooperating lower die cutting anvil. Such stitch tab die cutting blocks and lower die cutting anvil devices are generally well known in the art. A stitch tab cutting die block is carried on the outer edge of the upper male slotter head with the stitch tab cutting knife portion of the die block being oriented generally transversely to the direction of box blank travel. Both leading and trailing edge stitch tab die cutting blocks are usually carried by the same upper male slotter head. Their spacing along the circumference of the upper male slotter head is adjustable in accordance with the length of the particular corrugated paperboard box blanks on which they are operating.

The cooperating lower die cutting anvil has a resilient upper surface into which the cutting edge of the stitch tab die cutting knives will be pushed as the die cutting block and the lower die cutting anvil roll on and off each other. The stitch tab scraps are cut from the slotted box blank as the box blank passes through the nip point defined by the stitch tab die cutting knife and the surface of the lower die cutting anvil.

In operation, the leading and trailing stitch tab scraps are supposed to be completely severed from the scored and slotted paperboard box blanks by the action of the stitch tab die cutting knife cooperating with the lower die cutting anvil. The now separated stitch tab scraps are ejected forwardly, in the direction of travel of the box blanks by the continued counter-rotation of the cooperating stitch tab die cutting blocks and lower die cutting anvil. The cutting knives are set in the die blocks at a slight angle with respect to a line that is transverse to the direction of box blank travel. This provides a properly shaped stitch tab. It also is intended to cause the severed stitch tab scraps to be ejected forwardly and to the side of the cooperating stitch tab die cutting block and lower die cutting anvil. Such an ejection to the side is intended to reduce the possibility of the stitch tab scraps being sandwiched between the now scored, slotted and cut box blanks.

What, in theory, always happens, under actual production conditions, often does not happen. Specifically, the stitch tab scraps that have been cut from the box blanks, by operation of the stitch tab die cutting blocks and the cooperating lower die cutting anvil, are not ejected properly. There are several reasons that the ejection does not occur. The primary one is an incomplete cutting of the stitch tab scraps from the box blank. This frequently occurs because the transverse stitch tab cutting knife is not properly located and does not cut across the stitch tab all the way to the stitch tab slot. Alternatively, the cutting knife may have a dull area and does not effect a clean cut, but instead merely compresses a portion of the box blank along the cut line. The depth of cut of the cutting knife may be set incorrectly or the cutting knife may shift during production. The resilient surface of the lower die cutting anvil may be irregular due to prolonged usage and may not cooperate with the knife of the cutting die to define a proper cutting point.

Whatever the cause, the result is that the stitch tab scrap is not cleanly severed from the leading and/or trailing edge of the box blank. This results in the retention of the stitch tab scraps with the box blank as it is further processed in anticipation of these blanks being either formed into sleeves, by use of the stitch tab, or being sent on to the ultimate user unjoined. The inclusion of these non-stripped or non-ejected stitch tab scraps in the otherwise finished product prepared by the box blank manufacturer is not acceptable. It results in a product that cannot be properly stacked and handled by automatic machines. It also results in a product that is not truly finished.

Various stitch tab stripping devices are generally known in the industry. They are typically in the form of attachments to the die cutting block or slotter head and require a separate attachment operation, as well as modification of the slotter head. They thus add a separate assembly which must be aligned and coordinated with the die cutting blocks so that the stitch tab scraps will be stripped and ejected. They also tend to utilize pins that pass into the stitch tab scraps and that then require further stripper plates, or the like, to separate the stitch tab scraps from the pins. In use, these prior art stitch tab stripping devices have not met with a great deal of commercial success. They are often too complicated, require modifications to the die cutting blocks, do not function properly and simply do not perform in a dependable, repeatable manner to separate the stitch tab scraps from the blanks.

In view of these shortcomings of the available devices, there is a need in the industry for a stitch tab scrap stripper that will operate properly. The leading and trailing edge stitch tab strippers, in accordance with the present invention fill that need. They are a substantial improvement over the prior art.

SUMMARY OF THE INVENTION

It is an object of the present invention to provide a stitch tab scrap stripper.

Another object of the present invention is to provide leading and trailing edge stitch tab scrap strippers.

A further object of the present invention is to provide stitch tab scrap strippers that are operable with a corrugated paperboard box blank printer-slotter.

Yet another object of the present invention is to provide a stitch tab scrap stripper that is securable to a stitch tab die cutting block.

Still a further object of the present invention is to provide leading and trailing edge stitch tab scrap strippers which do not require modification of the upper male slotter head and the cooperating lower die cutting anvil.

Even yet another object of the present invention is to provide stitch tab scrap strippers which operate in a predictable, repeatable manner to insure that each stitch tab scrap is stripped.

As will be set forth in greater detail in the description of the preferred embodiments, the leading and trailing edge stitch tab scrap strippers, in accordance with the present invention are intended for use with stitch tab die cutting blocks mounted on an upper male slotter head that is cooperating with a lower die cutting anvil in a stitch tab cutting mechanism. The stitch tab scrap strippers, intended for both the leading and the trailing stitch tab die cutting blocks, utilize a stripper arm that has a pivot point intermediate its ends. The stripper arm is configured to engage the cutting die block, during at least part of the stitch tab cutting process, as accomplished by the cutting knife carried by the cutting die block. Once the die cutting block and the cooperating lower die cutting anvil have rolled off each other; i.e. once the transverse cutting of the stitch tab scrap has been accomplished, the stripper arm is caused to pivot, by a resilient element that is part of the stitch tab scrap stripper, so that the now cut stitch tab scrap will be cleanly ejected.

The stitch tab scrap strippers of the present invention are secured to the die block. While they require that the die blocks be adapted to receive them, they do not require any separate attachment to the upper male slotter head. The die blocks, with the stitch tab scrap strippers attached, are directly attachable to the upper male slotter head. No modification of the upper male slotter head is required.

The stitch tab scrap strippers, while they are in place on the die block, are always properly aligned with the stitch tab cutting block. There is no independent adjustment of the stitch tab scrap strippers required. Since they roll with the stitch tab cutting die block, they are adjacent the stitch tab cutting knife and will insure that the cut stitch tab scraps are stripped.

The principle of operation of the leading and trailing edge stitch tab scrap strippers, in accordance with the present invention, does not require a maintenance intensive configuration. A stripper arm is supported by the die block for pivotable movement of the arm about a pivot axis which is intermediate the ends of the stripper arm. A first, stripping end or segment of the pivotable stripper arm is provided with a piercing pin or pins whose purpose is to positively engage the stitch tab scrap being stripped. These pins do not puncture the stitch tab scraps to a depth that would require a separate stripper plate. The second, biasing end or segment of each pivotable stripper arm is engaged by a force applier, typically a resilient element, such as a spring. The force applier is adapted to pivot the stripper arm about its pivot axis. Such pivotal motion is used to eject the severed stitch tab scraps.

Both the leading and the trailing end stitch tab scrap strippers eject the cut stitch tab scraps forwardly in the direction of travel of the corrugated paperboard box blanks. The stripped stitch tab scraps are also ejected at a slight angle away from the upper male slotter head and the lower die cutting anvil. This facilitates removal of the stripped stitch tab scraps with a minimum of effort.

The leading and trailing edge stitch tab scrap strippers, in accordance with the present invention, overcome the limitations of the prior art. They function to cleanly, simply and dependably strip all of the leading and trailing edge stitch tab scraps from corrugated paperboard box blanks in an efficient, effective manner. They require no modification of the upper male slotter head and are adaptable to various stitch tab die cutting block configurations. The leading and trailing edge stitch tab scrap strippers, in accordance with the present invention, thus constitutes a substantial advance in the art.

BRIEF DESCRIPTION OF THE DRAWINGS

A full and complete understanding of the leading and trailing edge stitch tab scrap strippers, in accordance with the present invention, may be had by referring to the detailed description of the preferred embodiments, as is set forth subsequently, and as illustrated in the accompanying drawings; in which.

DESCRIPTION OF THE PREFERRED EMBODIMENTS

Figure 1:
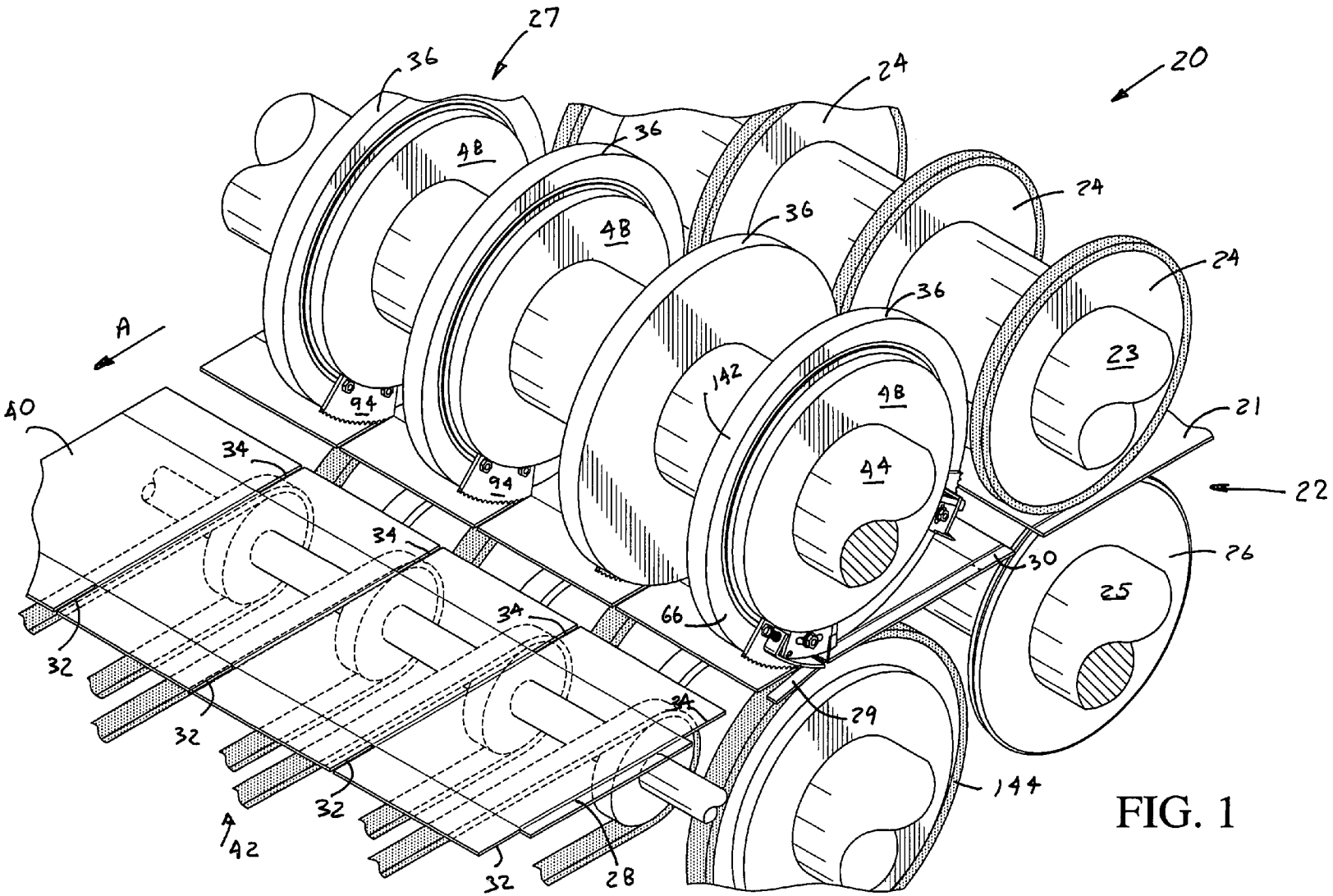
FIG. 1 is a perspective view of an upper male slotter head and lower die cutting anvil utilizing the leading and trailing edge stitch tab scrap strippers in accordance with the present invention.

Referring initially to FIG. 1, there may be seen, generally at 20, a first preferred embodiment of a leading and trailing edge stitch tab scrap stripper apparatus in accordance with the present invention. The leading and trailing edge stitch tab scrap stripper apparatus 20 is part of a much larger corrugated printer-slotter, which is not specifically depicted since it does not, itself, form a part of the present invention. Such an overall corrugated paperboard box blank printer-slotter, and its associated sheet delivery and stacking arrangements are fully described and depicted in applicant's co-pending U.S. patent application Ser. No. 10/253,696 which was filed on Sep. 25, 2002 and the entire specification and drawings of which are expressly incorporated herein by reference.

As may be seen in FIG. 1, a corrugated paperboard box blank 21, which may have been printed, is received from the printing cylinder of the printer-slotter, which is not specifically shown, by a set of cooperating scoring rollers generally 22. The cooperating scoring rollers 22 include an upper scoring shaft 23, which carries a plurality of spaced female scoring anvils 24, and a lower scoring shaft 25 which carries a similar number of male scoring heads 26. These intermediate scoring rollers 22 are counter-rotating and serve to forward the printed and scored corrugated paperboard box blanks 21 along to the slotting section 27. This slotting section 27 accomplishes the slotting of the leading and trailing edges of the box blank 21, as will be discussed in detail shortly.

Referring again to FIG. 1, it will be seen that each box blank 21 has been scored in its longitudinal direction to define a folding line for a stitch tab 28 to be formed in the slotting section 27. As the individual blanks 21 pass through a nip defined by a stitch tab die cutting knife block, secured to an upper male slotter head, and a cooperating lower die cutting anvil, which is part of the slotting section 27, and which will be described in detail shortly, the leading and trailing ends of the box blank 21 are suitably slotted along the previously formed score lines. Various ones of these slots define top and bottom flaps. The stitch tab die cutting knife block is used to form the stitch tab 28. At the same time, stitch tab scraps 29 and 30 are severed from the blank 21. The resultant slotted and stitch tab scrap-free blank 40 is taken away from the slotting section 27 by a downstream belt conveyor assembly 42. That belt conveyor assembly 42 can be a "lay boy" as described in applicant's co-pending application identified above. The belt conveyor assembly 42 also does not form a part of the present invention.

Figure 2:
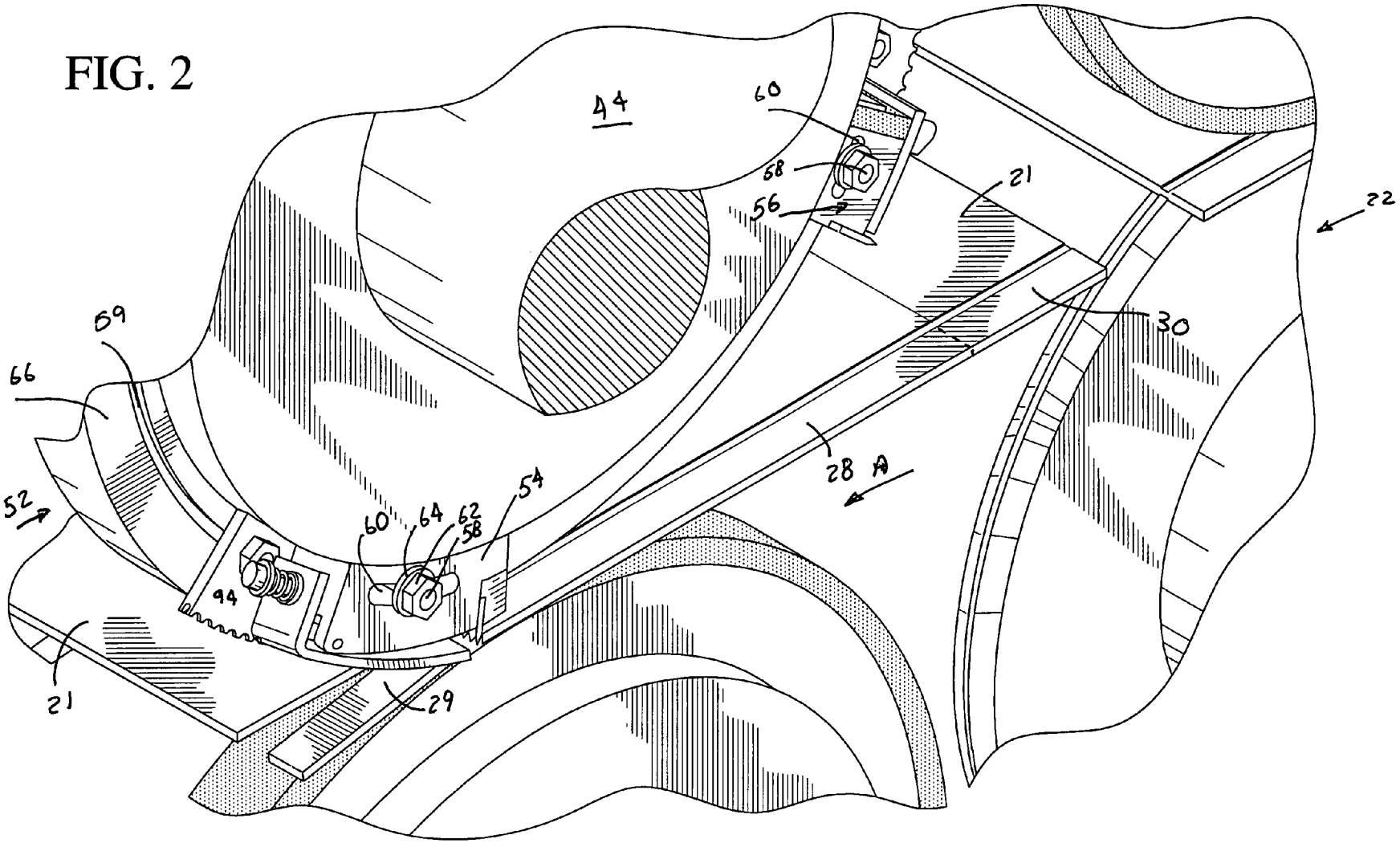
FIG. 2 is an enlarged perspective view of a portion of the device shown in FIG. 1 and showing a leading edge stitch tab scrap stripper ejecting a severed stitch tab scrap.

Turning now to FIG. 2, and taken in conjunction with FIG. 1, there is shown in greater detail the slotting section 27 which operates to slot the leading and trailing ends of the box blank 21 and to cut the leading and trailing edge stitch tab scraps 29 and 30 from the scored, box blanks 21 as the blanks 21 travel in the blank travel direction A. A plurality of spaced upper male slotter heads 36 are securely attached to an upper slotter shaft 44 by any suitable structure, which is not specifically shown. It will be understood that the upper male slotter heads 36 are shiftable axially along shaft 44 so that box blanks 21 of differing dimension, transverse to the travel direction A, can be processed. A plurality of the upper male slotter heads 36 are supported on the upper slotter shaft 44. These upper male slotter heads 36 are provided with support collars 48 that accomplish the placement of the upper male slotter heads 36 on the upper slotter shaft 44 in an axially adjustable manner. It is to be kept in mind that the discussion directed to the leading and trailing edge stitch tab scrap stripper, while referring to one side of the box blank 21, is equally applicable to the other side of the box blank. A stitch tab die cutting knife block could alternatively be attached to the upper slotter shaft 44 so as to overlie the further lateral or side edge of the box blank 21, as seen in FIG. 1.

Referring again to FIG. 2, each upper male slotter head 36 is of stepped configuration and includes a reduced diameter support hub 48 and a larger diameter outer slotter roller 52.

The diameter of the outer slotter rollers 52, for all of the upper male slotter heads 36 are essentially the same. This insures that the box blanks 21 will be driven forward in the travel direction A by these upper male slotter heads 36 without being skewed or twisted.

A leading edge stitch tab die cutting block 54, and a trailing edge stitch tab die cutting block 56 are both secured to the outer slotter roller 52 of the outermost one of the upper male slotter heads 36, as shown in FIG. 2. This is accomplished by the use of a die block mounting stud or T-headed bolt 58 which is received in an elongated slot 60 in each of the die blocks 54 and 56. Suitable nuts 62 and lock washers 64, as is generally conventional in the art, are used to secure the die blocks 54 and 56 to the outer slotter roller 52 of the upper male slotter head generally at 36. It will be understood that these studs or T-headed bolts 58 are typically received in a circular channel 59 extending around the outer slotter roll side flank 66 to accommodate the positioning of the leading and trailing edge stitch tab cutter die blocks 54 and 56 at suitable peripheral locations in accordance with the length of the box blanks 21 being processed.

Figure 3:
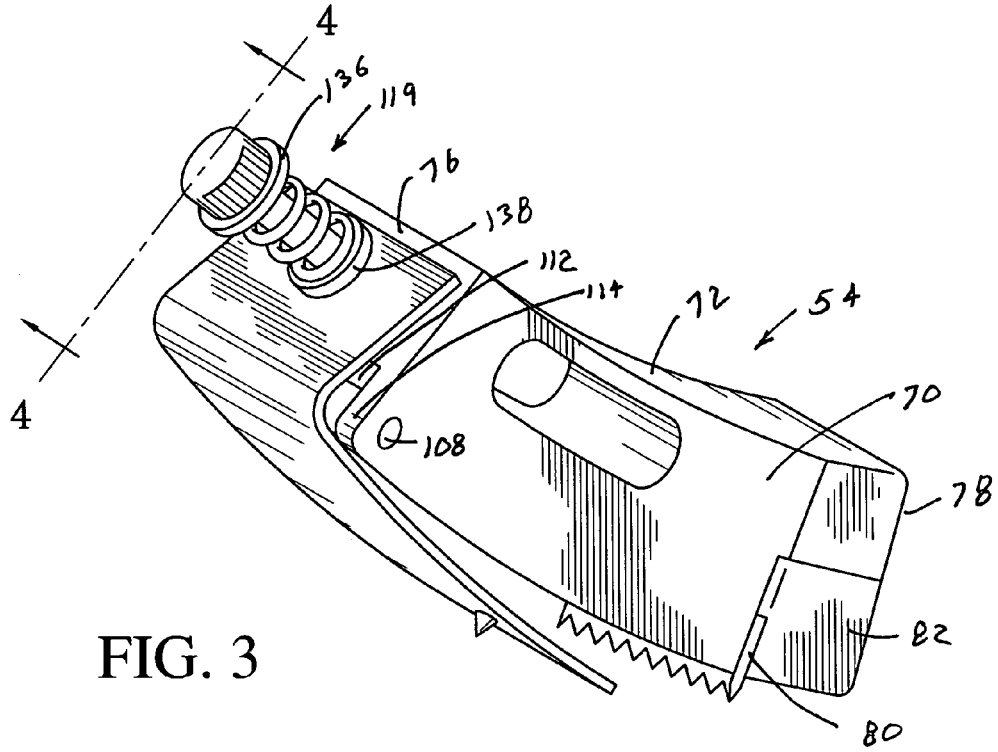
FIG. 3 is a perspective view of a leading edge stitch tab scrap stripper attached to a die block in accordance with the present invention.
Figure 4:
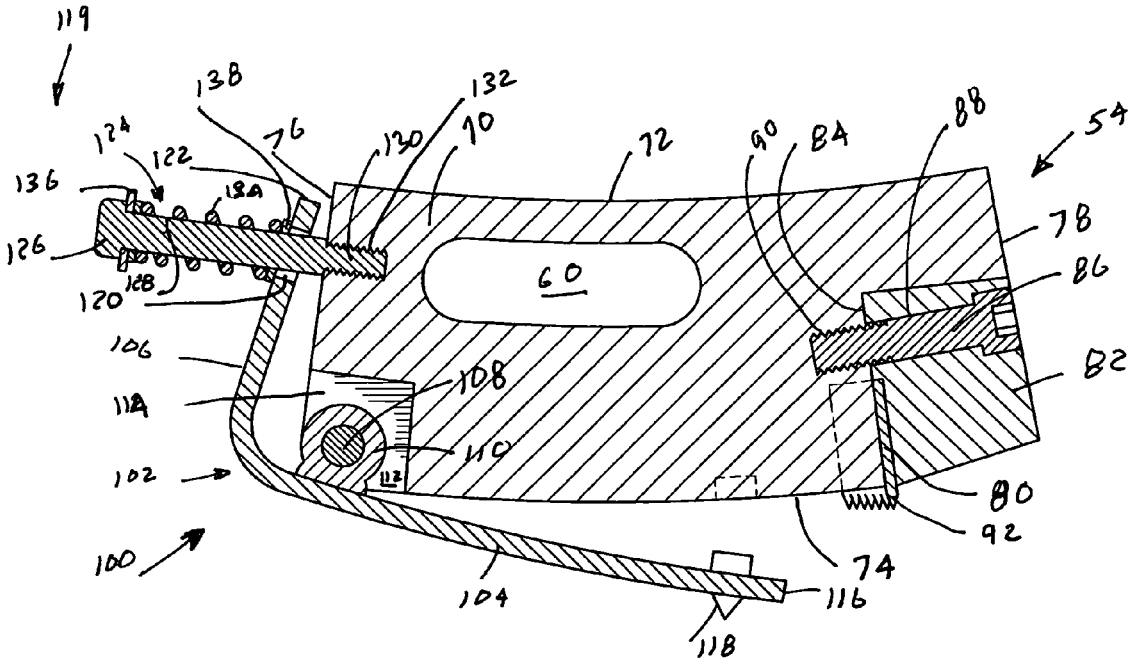
FIG. 4 is a cross-sectional view of the leading edge stitch tab scrap stripper and die block shown in FIG. 3 and taken along the line 4—4 of FIG. 3.

A leading edge stitch tab cutting block 54, with a leading edge stitch tab stripper in accordance with the present invention is shown in detail in FIGS. 3 and 4. The leading edge stitch tab die cutting block 54 has a block body 70 that is generally arcuate and that includes an upper or inner hub engaging surface 72 and a lower or outer surface 74. The die block 54 also has a leading end 76 and a trailing end 78. It will be understood that the terms "upper," "lower," "leading" and "trailing" are taken in the context of the orientation of the leading edge tab cutter die block 54 shown in FIGS. 1 to 4. This is the operative orientation of the die block 54.

Leading edge stitch tab die cutter block body 70 includes the elongated arcuate slot 60, which, as discussed above, is used to adjustably secure the die block 54 to the side flank 66 of the outer slotter roller 52 of the upper male slotter head 36. It is possible that other attachment assemblies may be provided on the die block body since various stitch tab cutter die blocks may well include various attachment mechanisms.

The leading edge stitch tab cutter die block body 70 supports a leading edge tab cutter knife 80 which, as seen in FIGS. 3 and 4 is attached to the trailing end 78 of the die block body 70. A knife securement strip 82 is shaped to cooperate with an undercut 84 in the die block body 70. At least one securement screw 86 passes through an aperture 88 in the knife securement strip 82 and into a threaded bore 90 in the die block body 70. Several such screws 86 can be provided. The generally planar leading edge tab cutter knife 80 is sandwiched between the strip 82 and the undercut 84 and is held in place by a tightening force applied by the securement screw or screws 86. The knife 80 has a serrated cutting edge 92 which extends down below the lower or outer surface of the die block body 70. As will be seen in FIG. 4, the knife 80 is slightly angled with respect to the axis of rotation of the upper slotting shaft 44. This slight angle of the knife 80 will aid in ejecting the severed stitch tab scraps 29, 30 axially outwardly.

In a generally conventional manner, suitable upper slotter dies 94 are also attached to the upper male slotter heads 36, as seen in FIG. 1. These upper slotter dies 94 cut the various leading and trailing edge slots 32 and 34 in the box blanks 21 as the box blanks pass through the slotter section 27. Such upper slotter dies 94 are known in the art and need not be discussed in detail.

A leading edge stitch tab scrap stripper, generally at 100, in accordance with the present invention, is secured to the die block body 70 of the leading edge tab cutter die block 54. Leading edge stitch tab scrap stripper 100 includes a pivot arm 102 that has a stripper segment 104 and a biasing segment 106. As seen in FIG. 4, these two segments 104 and 106 are separated or are defined by an intermediate pivot shaft 108 which is supported by a central journal 110. This journal 110 is receivable in a cooperatively shaped recess 112 which is located in the leading block body 70 at the juncture of the block's outer surface 74 and its leading end 76. A pair of ears 114 define the ends of the recess 112 and receive the ends of the pivot shaft 108. A first or free end 116 of the stripper segment 104 of the stitch tab scrap stripper pivot arm 102 is configured so that it is parallel to the leading end 76 of the block body 70. One or more stripper pins 118 are disposed in the stripper segment 104 inboard of the free end 116. These stripper pins 118 can engage a leading edge stitch tab scrap to be ejected, as will be discussed subsequently. The stripper segment 104 of the pivot arm 102 is shaped so that it can lie flat against the cooperatively shaped outer or lower surface 74 of the leading edge cutter die block body 70.

The biasing segment 106 of the leading edge stitch tab stripper assembly 100 generally overlies the leading end 76 of the block body 70. A biasing segment biasing assembly 119 is used to exert a bias on the biasing segment 106, as seen in FIGS. 3 and 4. The biasing segment 106 of the pivotable arm 100 includes an opening 120 adjacent a free end 122. A biasing stud 124 has a head 126, a shank 128 and a threaded end 130. The threaded end 130 of the shank 128 passes through the opening 120 and is received in a threaded blind bore 132 located in the leading end 76 of the die block body 70. A coil spring 134 overlies the shank 128 of the biasing stud 124 and is held between an outer washer 136 adjacent the stud head 126, and an inner washer 138 adjacent the free end 122 of the biasing segment 106 of the pivot arm 102 of the leading edge stitch tab scrap stripper 100. The spring force exerted by the coil spring 134 acts to force the free end 122 of the biasing segment 106 against the leading end 76 of the die block body 70. This, in turn causes the stripper segment 104 of the pivot arm 102 to, in its rest position have its free end 116 spaced radially outwardly from the lower or outer surface of the die block body 70, all as seen most clearly in FIG. 4.

Figure 9:
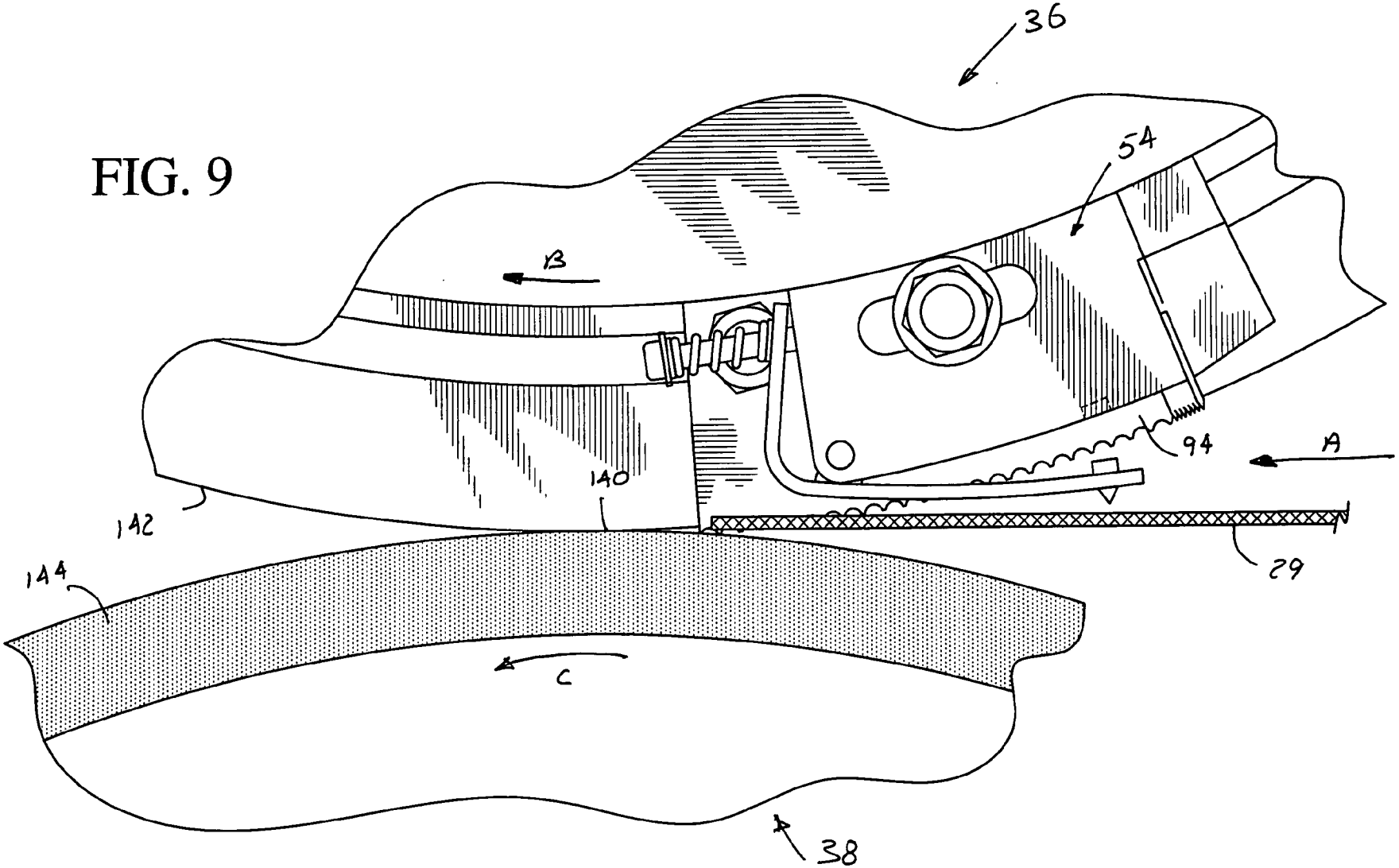
FIG. 9 is a side elevation view of the leading edge stitch tab scrap stripper and die block prior to the severing of the leading edge stitch tab scrap.
Figure 10:
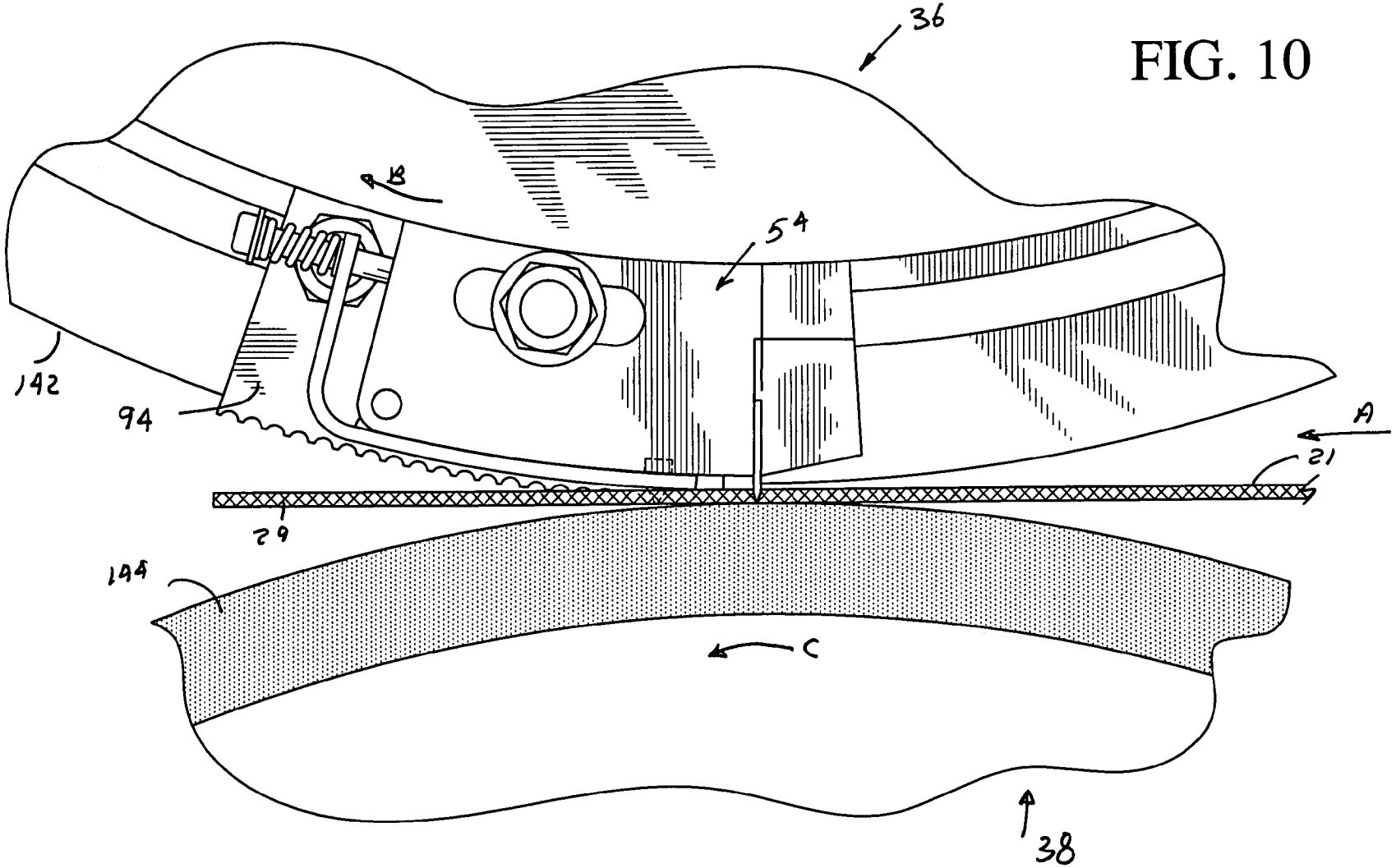
FIG. 10 is a view similar to FIG. 9 and showing the severing of the leading edge stitch tab scrap.
Figure 11:
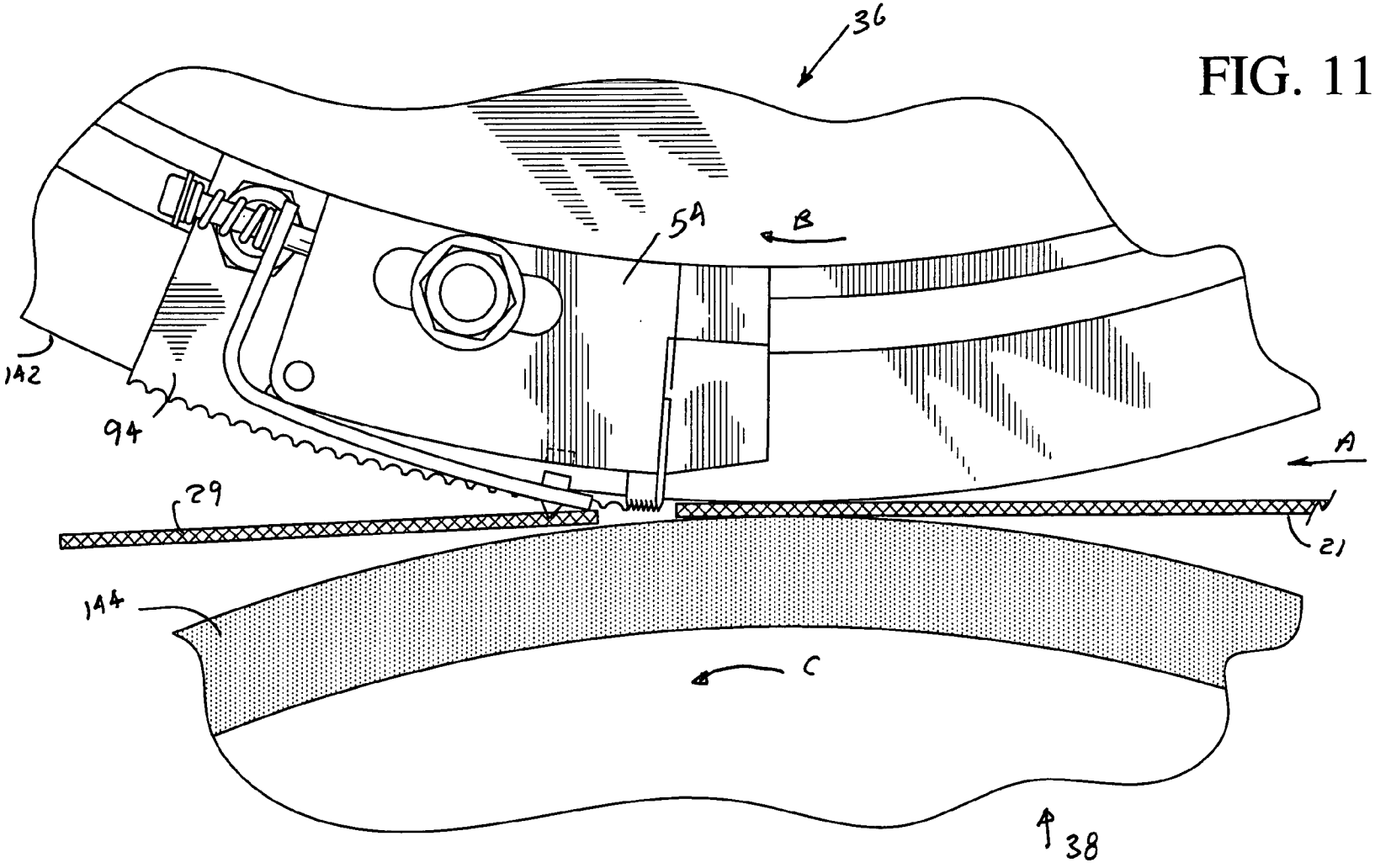
FIG. 11 is a view similar to FIGS. 9 and 10 and showing the stripping or ejection of the now severed leading edge stitch tab scrap.

Referring to FIGS. 9 to 11, there is depicted an operative sequence of the leading edge stitch tab stripper in accordance with the present invention. The box blank 21, whose leading edge stitch tab scrap 29 is to be stripped, is driven in the transport direction A by the scoring rollers 22, as depicted in FIG. 1. The leading end of the box blank 21 enters into a nip 140 which is defined by a circumferential surface 142 of the upper male slotter roller 52 and an outer resilient circumferential surface layer 144 of the lower die cutting anvil 38. As seen in FIG. 9, the leading edge stitch tab die block 54 has not yet reached the nip 140. The upper male slotter head 36 and the lower die cutting anvil 38 are counter-rotating so that as the upper male slotter head 36 rotates in a clockwise direction B and the lower die cutting anvil 38 rotates in a counter-clockwise direction C, as seen in FIG. 9 they will cooperate to pull the box blank 21 through the nip 140 in the travel direction A.

In the position depicted in FIG. 9, the stitch tab scrap stripper segment 104 of the pivot arm 102 leading edge stitch tab scrap stripper assembly 100 is spaced from the cooperatively shaped outer surface 74 of the die block body 70 by the action of the coil spring 134 biasing the free end of the biasing segment 106 of the pivot arm 102 against the leading end 76 of the die block body 70.

Turning now to FIG. 10, the upper male slotter head 36 and the lower die cutting anvil 38 have counter rotated with respect to each other so that the box blank 21 is now passing through the nip 140 and its leading stitch tab scrap 29 is being severed by the cutting edge 92 of the cutting knife 80. The passage of the die block 54 through the nip 140 causes the stripper section 104 of the pivot arm 102 to be forced into engagement with the undersurface 74 of the die block body 70. This movement of the pivot arm 102 about its pivot shaft or axis 108 is opposed by a compressing of the coil spring 134 since the free end 122 of the biasing segment 106 of the pivot arm 102 is forced in the direction of box blank travel A toward the head 126 of biasing stud 124. The abutting of the stripper segment 104 against the block body lower surface 74 causes the tip of the stripper pin 118 to puncture the box blank 21.

In the third phase of the operative sequence, as depicted in FIG. 11, the upper male slotter head 36 and lower die cutting anvil 38 have counter-rotated in their respective directions of rotation B and C so that the leading edge stitch tab cutter die block 54 has now passed beyond the nip area 140. This now releases the stripper segment 104 from its sandwiched position between the die block body 70 and the resilient surface 144 of the lower die cutting anvil 38. The released stripper segment 104 is caused to move about the pivot axis 108 by the spring force being exerted by coil spring 134 on the biasing segment 106 of the pivot arm 102. This downward movement of the free end 116 of the stripper segment 104 occurs with sufficient force, and velocity, to cause the now severed leading stitch tab scrap 29 to be completely separated from the box blank 22, if such complete separation has not been accomplished by the operation of the cutting knife 80, and to be ejected forwardly in the travel direction A and partially to the side of the assembly. The stripping force exerted on the leading edge stitch tab scrap 29, during the pivotal movement of the pivot arm 102 will be sufficient to dislodge the now stripped stitch tab scrap 29 from the pin or pins 118.

Turning now to FIGS. 5–8, a trailing edge stitch tab die block 56, which is provided with two preferred embodiments of a trailing end stitch tab scrap stripper assembly, is depicted. It will initially be understood that the overall structure and operative principle of the trailing edge stitch tab scrap stripper is the same as that discussed above in connection with the leading edge stitch tab scrap stripper assembly. Since the trailing edge stitch tab die block 56 is arranged to sever a trailing edge tab scrap 30, and to eject it forward in the direction of travel A, the orientation of the pivot arm of the trailing edge stitch tab scrap stripper on its associated trailing edge die block is reversed from that of the leading edge stitch tab stripper.

Figure 5:
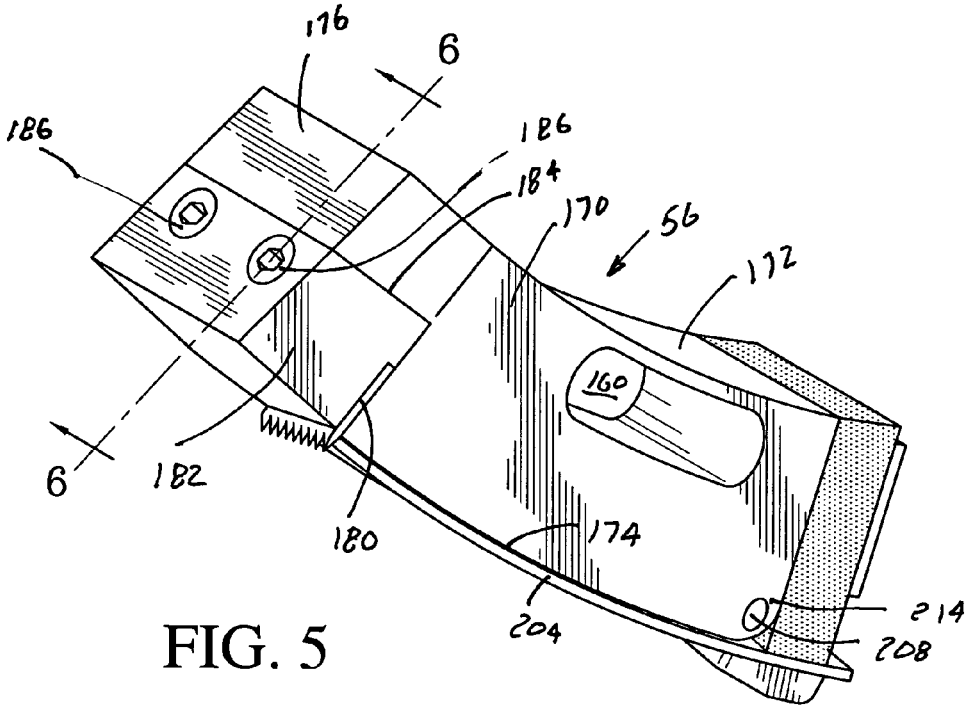
FIG. 5 is a perspective view of a first preferred embodiment of a trailing edge stitch tab scrap stripper attachment for a die block, in accordance with the present invention.
Figure 6:
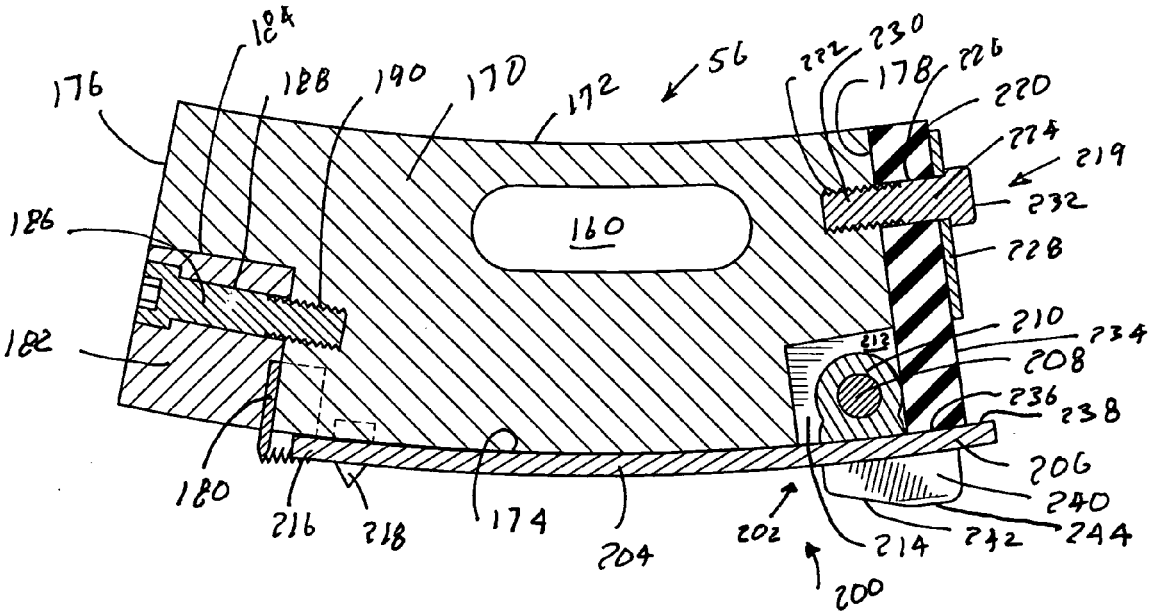
FIG. 6 is a cross-sectional view of the trailing edge stitch tab scrap stripper and die block shown in FIG. 5 and taken along the line 6—6 of FIG. 5.

Referring initially to FIGS. 5 and 6, the trailing edge stitch tab scrap stripper die block 56 has a generally arcuate block body 170 which includes an upper surface 172, a lower or outer surface 174, a leading end 176 and a trailing end 178. An elongated arcuate slot 160 is provided in the trailing end body 56 and is used to attach the trailing end stitch tab scrap stripper die block 56 to the upper male slotter head side flange 66 in the same manner, and with the same adjustability as was previously discussed in connection with the leading edge stitch tab stripper die block 54.

Because the trailing end stitch tab scrap 30 is to be cut or severed prior to passage of the trailing end stitch tab scrap 30 through the nip 140, the trailing edge stitch tab cutting knife 180 is attached to the trailing end stitch tab die block 56 generally adjacent the leading end 176 of the block body 170. This attachment is accomplished in the same manner as was done with the leading edge stitch tab cutter knife 80. A knife securement strip 182 is configured to be received in a cooperatively shaped undercut 184 and is held in place by one or more securement screws 186. The blade securement strip 182 has an aperture 188 that receives the securement screw 186, with a threaded end of the securement screw 186 being received in a threaded bore 190.

A trailing edge stitch tab scrap stripper 200 is attached to the trailing edge die block 56. As may be seen in FIGS. 5 and 6, the trailing edge stitch tab scrap stripper 200 is comprised of a pivot arm 202 which is divided into a forwardly extending stripper segment 204 and a rearwardly extending biasing segment 206. A pivot shaft 208 extends through a pivot shaft journal 210 which is formed on an inner or upper surface of the pivot arm 202 between the stripper segment 204 and the biasing segment 206. The pivot shaft 208 extends beyond the confines of a recess 212 in the die block body 170, which recess receives the journal 210, and is secured in spaced ears 214 situated outboard of recess 212 and generally at the juncture of the rear die block body rear wall 178 and lower surface 174. A free end 216 of the stripper segment 204 of the trailing edge stitch tab scrap stripper pivot arm 202 is situated adjacent the angled knife 180. This free end 216 is equipped with one or more stripper pins 218 whose function and operation is the same as the stripper pin or pins 118 discussed in connection with the leading edge stitch tab stripper pivot arm 102.

A biasing segment biasing assembly, generally at 219 is utilized to exert a biasing force on the pivot arm 202 so that the pivot arm 202 will pivot about its pivot shaft 208 in order to strip and to eject trailing edge stitch tab scraps 30, in the same manner as was done by the pivot arm 102 of the leading edge stitch tab scrap stripper 100. A resilient strip 220, such as a rubber block, is attached to the rear face 178 of the rear die block 170, which has a threaded blind bore 222 that is adapted to receive the threaded shank 230 of a stud 224. That stud 224 passes through an aperture 226 in the resilient strip 220. A washer plate 228 is interposed between a head 232 of the stud 224 and an outer surface 234 of the resilient strip 220.

A lower end 236 of the resilient strip 220 abuts an upper surface 238 of the biasing segment 206 of the pivot arm 202. The resiliency of the resilient strip 220 is selected to be adequate to cause the stripper segment 204 of the pivot arm 204 to be biased into engagement with the cooperatively shaped lower surface 174 of the die block body 170.

A fulcrum block 240 is attached, by suitable fasteners or bonding, to the lower surface of the biasing segment 206. This fulcrum block 240 has a first or leading sloped camming surface 242 and a trailing, or second generally planar camming surface 244.

Figure 12:
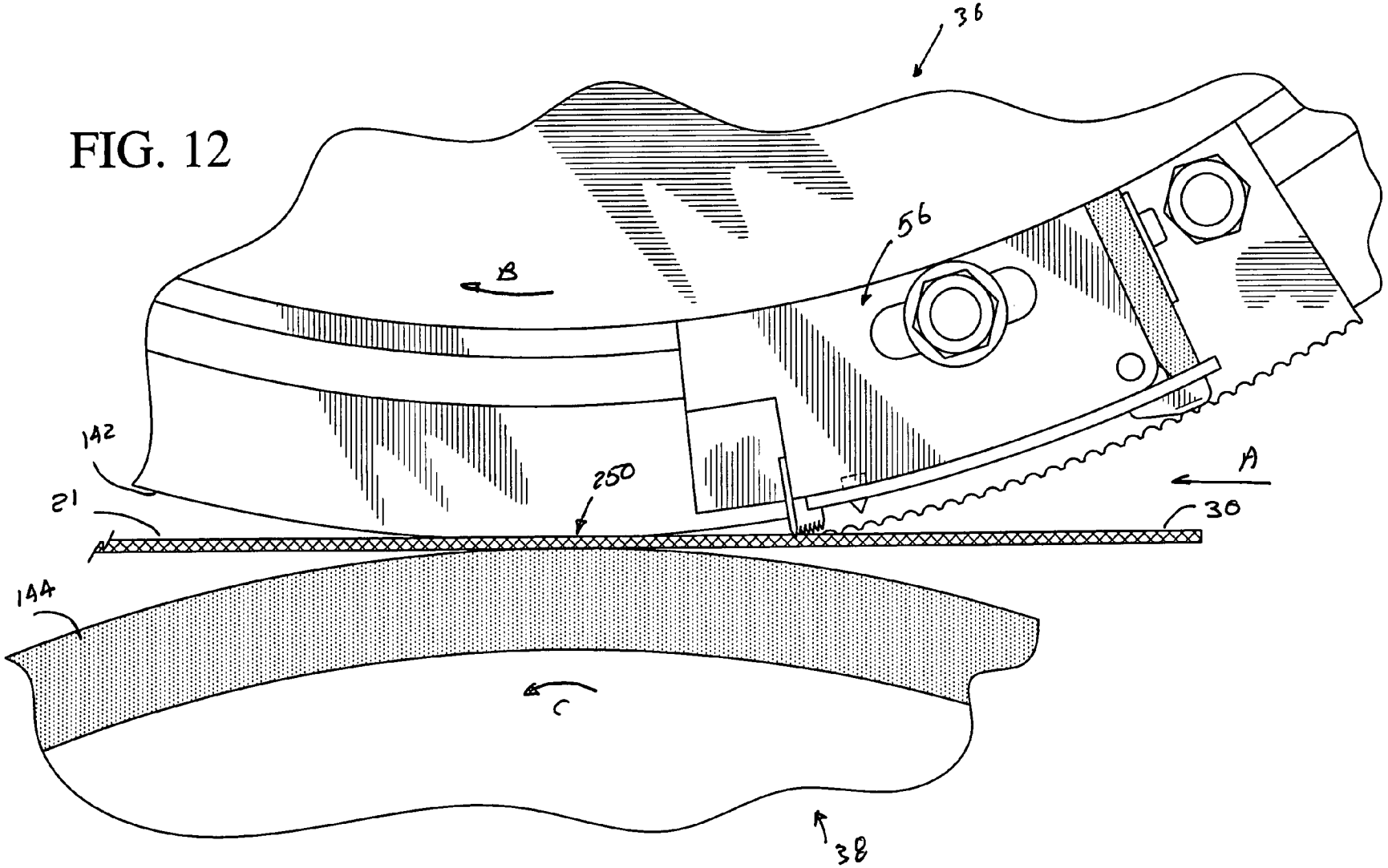
FIG. 12 is a side elevation view of a trailing edge stitch tab scrap stripper in accordance with the present invention prior to severing of the trailing end stitch tab scrap.
Figure 13:
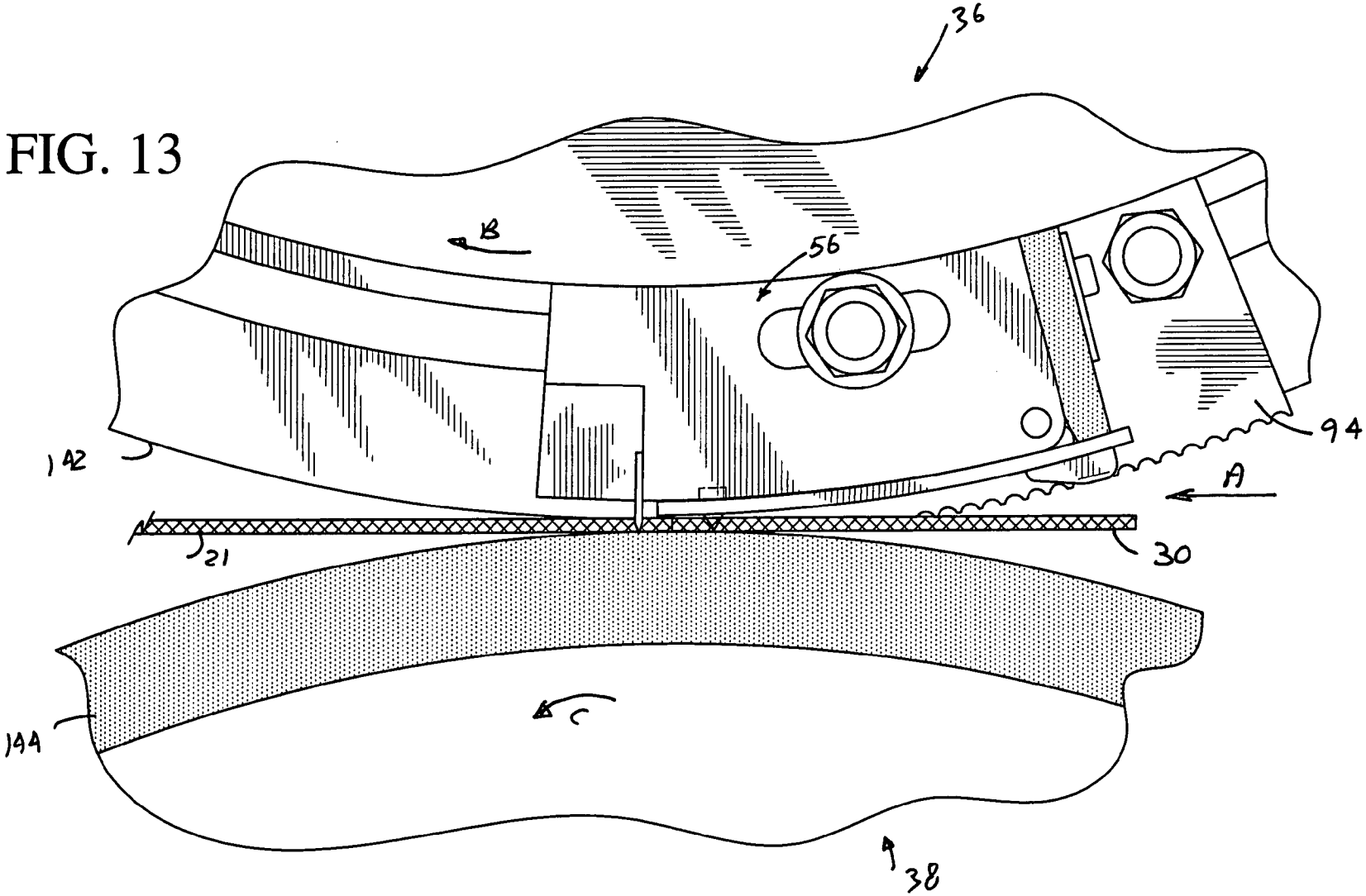
FIG. 13 is a view similar to FIG. 12 and showing the severing of the trailing edge stitch tab scrap.
Figure 14:
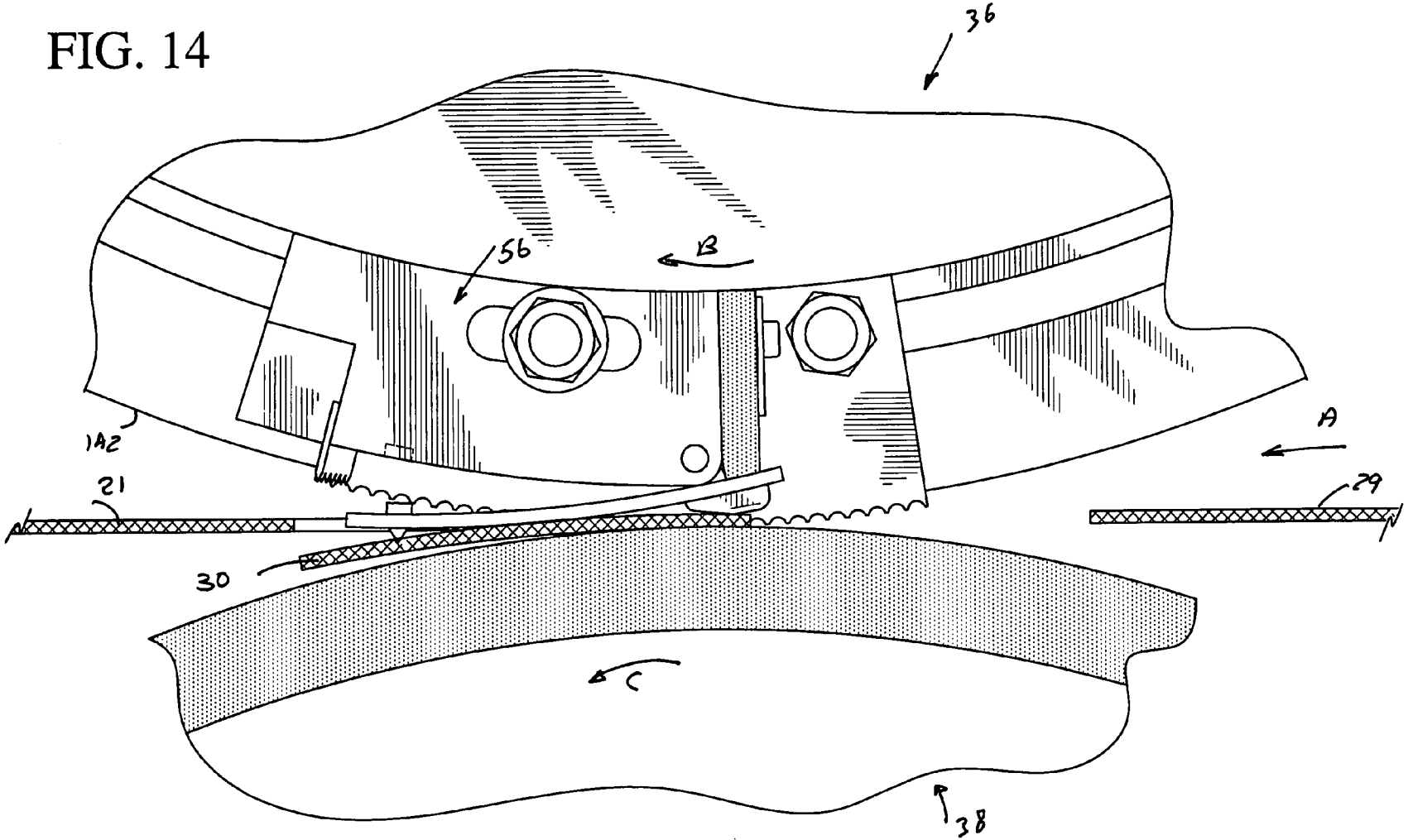
FIG. 14 is a view similar to FIGS. 12 and 13 and showing the ejection or stripping of the now severed trailing edge stitch tab scrap.

Referring now to FIGS. 12–14, an operational sequence of this first preferred embodiment of a trailing edge stitch tab scrap stripper in accordance with the present invention will be described. As seen in FIG. 12, the corrugated paperboard box blank 21 is held in a nip 250 between the circumferential surface 142 of the upper male slotter head 36, and specifically between the outer slotter roller portion 52 thereof, and the resilient surface 144 of the lower die cutting anvil 38. It will be understood that the trailing edge stitch tab scrap 30 has not yet been stripped from the box blank 21 but that the leading edge stitch tab scrap 29 has been stripped, as was discussed previously. In the position of the upper male slotter head 36 and the lower die cutting anvil 38 depicted in FIG. 12, the stripper segment 204 of the pivot arm 202 is biased into contact with the die block undersurface 174 by the force exerted on the biasing segment 206 by the resilient strip 220.

Now turning to FIG. 13, it will be seen that the cutter knife 180 has severed the trailing edge stitch tab scrap 30 from the box blank 21, and that the stitch tab scrap 30 has been pierced by pin 218, but that the stitch tab scrap 30 has not yet been stripped. The pivot arm 202 of the trailing edge tab scrap stripper 200 has not yet moved. By the continued counter-rotation of the upper male slotter head 36 and the lower die cutting anvil 38, the knife 180 moves out of the nip 250. The trailing edge stitch tab scrap 30 of the box blank 21 is now sandwiched between the lower die cutting anvil 38 and the fulcrum block 240 of the biasing segment 206 of the pivot arm 202 of the trailing edge tab stripper 200. The leading, sloped camming surface 242 causes the pivot arm 202 to pivot about its pivot shaft 208 thereby moving the stripper segment's free end 216 away from the undersurface 174 of the die block body 170 simultaneously lifting the lead edge of the trailing edge stitch tab scrap 30 away from the box blank 21 while being held between the lower die cutting anvil 38 and the fulcrum block 240. Continued rotation of the upper male slotter head 36 and of the lower die cutting anvil 38 cause the planar camming surface 244 of the fulcrum block 240 to hold the stripper segment 204 away from the block undersurface 174. As the fulcrum block 240 moves out of the nip 250, the resilient strip 220 pushes down on the upper face 238 of the biasing segment 206 of the pivot arm 202. This causes the pivot arm 202 to return to its position depicted in FIGS. 5, 6 and 12 and ejects the now severed and stripped trailing edge stitch tab scrap 30 generally forwardly in the direction of box blank travel A and slightly axially out away from the subsequent conveyor or lay boy.

Figure 7:
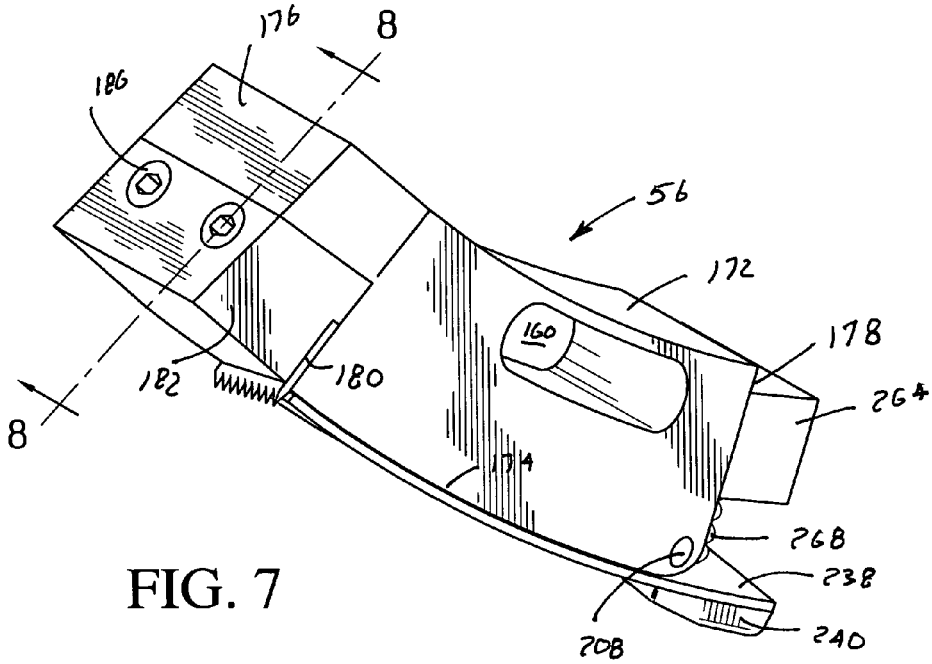
FIG. 7 is a perspective view of a second preferred embodiment of a trailing edge stitch tab scrap stripper and die block in accordance with the present invention.
Figure 8:
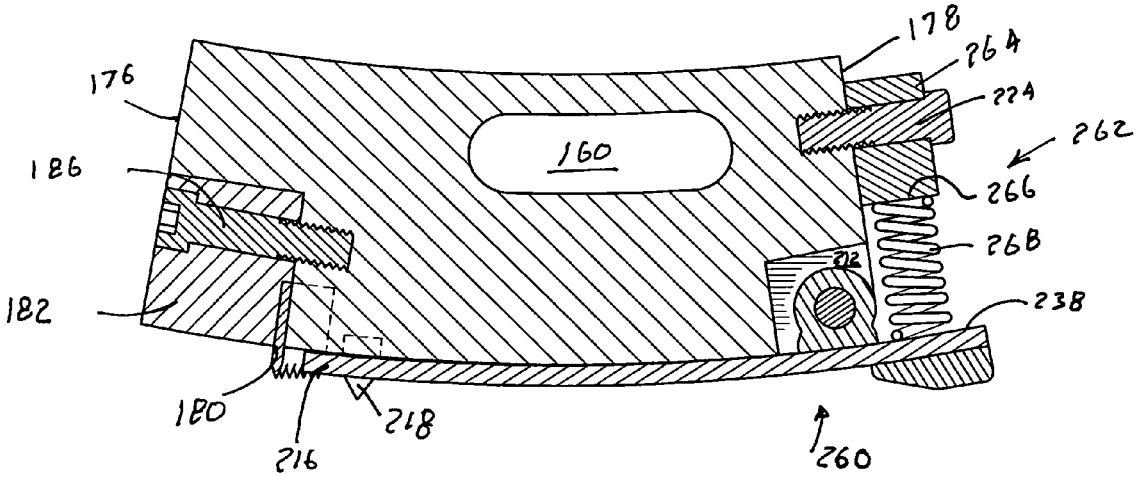
FIG. 8 is a cross-sectional view of the trailing edge stitch tab scrap stripper and die block of FIG. 7 and taken along line 8—8 of FIG. 7.

The second preferred embodiment of the trailing edge stitch tab scrap stripper in accordance with the present invention, and as seen generally at 260 in FIGS. 7 and 8 is functionally the same as the first preferred embodiment generally at 200, as discussed in connection with FIGS. 5 and 6. In both of these embodiments, the same reference numerals are used to identify similar parts. In the second preferred embodiment 260 of the trailing edge stitch tab scrap stripper, the biasing assembly 262 is constituted by a spring assembly instead of a resilient strip. This may be advantageous if it is appropriate to change the biasing force in accordance with variations in box blank characteristics or possibly for greater ease of adjustment. In the biasing assembly 262 shown in FIGS. 7 and 8, the stud 224 is used to secure a spring retainer block 264 to the rear face 178 of the die block body 170. The spring retainer block 264 has a lower or radially outer face 266 and is configured to receive a compression spring 268 between its lower or outer face 266 and the upper surface 238 of the biasing segment 206 of the pivot arm 202 of the trailing edge stitch tab stripper 200. This second preferred embodiment 262 of the trailing edge stitch tab scrap stripper in accordance with the present invention functions in the same manner as its previously described counterpart 200. Its operation will thus not be discussed in detail and is not specifically depicted. It will be understood that the operational sequence shown in FIGS. 12–14 is equally applicable to the second preferred embodiment of the trailing edge stitch tab stripper 262 as it was to the first preferred embodiment 200 of the same device.

For ease of visualization, not all of the reference numerals and lead lines have been applied to similar elements in each of the drawings. It will be understood that, in the absence of the duplication of such lead lines and numerals, that the same structures depicted in several views are the same.

While preferred embodiments of leading and trailing edge stitch tab scrap strippers, in accordance with the present invention, have been set forth fully and completely hereinabove it will be apparent to one of skill in the art that various changes in, for example the overall sizes of the rollers, the particular drives for the shafts, the specific composition of the box blanks and the like could be made without departing from the true spirit and scope of the present invention which is accordingly to be limited only by the following claims.

What is claimed is:

1. A stitch tab scrap stripper and die comprising:

a pivot arm having a stripper segment and a biasing segment;

a pivot shaft on said pivot arm intermediate said stripper segment and said biasing segment, said pivot shaft pivotably securing said pivot arm to a stitch tab die cutting block, said stitch tab die cutting block being securable to a slotter roller of a box blank slotter;

biasing means engaging said biasing segment of said pivot arm and exerting a biasing force on said biasing segment, said biasing force opposing movement of said stripper segment with respect to said stitch tab die cutting block about said pivot shaft; and stitch tab scrap engaging means on said stripper segment and spaced from said pivot shaft, said stripper segment of said pivot arm acting to eject a stitch tab scrab severed from a box blank in response to movement of said biasing segment about said pivot shaft, said stripper segment being moved away from said stitch tab die cutting block during rotation of the slotter roller of the box blank slotter.

2. The stitch tab scrap stripper of claim 1 further including a journal on said pivot arm, said journal supporting said pivot shaft.

3. The stitch tab scrap stripper of claim 1 wherein said biasing means includes a resilient member.

4. The stitch tab scrap stripper of claim 3 wherein said resilient member is a resilient strip.

5. The stitch tab scrap stripper of claim 3 wherein said resilient member is a spring.

6. The stitch tab scrap stripper of claim 3 further including a biasing stud connecting said resilient member to said stitch tab a die cutting block.

7. The stitch tab scrap stripper of claim 6 wherein said resilient member is a coil spring.

8. The stitch tab scrap stripper of claim 7 wherein said biasing segment has a free end spaced from said pivot shaft, and a hole at said free end, said biasing stud passing through said hole.

9. The stitch tab scrap stripper of claim 8 wherein said coil spring is positioned about said bolt and contacting said free end of said biasing segment.

10. The stitch tab scrap stripper of claim 7 further including a spring retainer block.

11. The stitch tab scrap stripper of claim 10 wherein said coil spring is positioned intermediate said spring retainer block and said biasing segment of said pivot arm.

12. The stitch tab scrap stripper of claim 1 further including a fulcrum block on said biasing segment of said pivot arm.

13. The stitch tab scrap stripper of claim 1 wherein said stripper segment and said biasing segment are co-planar.

14. The stitch tab scrap stripper of claim 1 wherein said stripper segment and said biasing segment are not co-planar.

15. The stitch tab scrap stripper of claim 1 wherein said stitch tab scrap engaging means is at least one stripper pin positionable adjacent an outboard end of said stripper segment.

16. A stitch tab scrap stripper comprising:

a pivot arm having a stripper segment and a biasing segment;

a pivot shaft on said pivot arm intermediate said stripper segment and said biasing segment, said pivot shaft being adapted to pivotably secure said pivot arm to a die block;

biasing means engaging said biasing segment and exerting a biasing force on said biasing segment, said biasing force opposing movement of said stripper segment about said pivot shaft;

stitch tab scrap engaging means on said stripper segment and spaced from said pivot shaft;

a fulcrum block on said biasing segment of said pivot arm; and a leading, sloped camming surface on said fulcrum block and a trailing, planar camming surface on said fulcrum block.

17. A stitch tab scrap stripper and die adapted for use in stripping stitch tab scraps severed from box blanks in a rotary box blank slotter comprising:

a stitch tab die cutting block securable to a rotary male slotter head, said stitch tab die cutting block having a die block body;

a stitch tab cutting knife mounted in said die block body;

a pivot arm secured to said die block body, said pivot arm including a stripper segment having a first free end and a biasing segment having a second free end;

a pivot connection between said pivot arm and said die block body, said pivot connection separating said pivot arm into said stripper segment and said biasing segment; and biasing means engaging said die block body and said biasing segment of said pivot arm, said biasing means exerting a force on said biasing segment and opposing movement of said stripper segment with respect to said die block body, said movement of said stripper segment with respect to said die block body acting to eject a stitch tab scrap severed from the box blank by said stitch tab cutting knife in response to said movement of said stripper segment during rotation of the rotary male slotter head of the rotary box blank slotter.

18. The stitch tab scrap stripper of claim 17 wherein said biasing means moves said stripper segment in a stitch tab scrap stripping direction.

19. A stitch tab scrap stripper and die adapted for use in stripping stitch tab scraps from box blanks comprising:

a die block adapted to be secured to a male slotter head and having a die block body;

a stitch tab cutting knife mounted in said die block body;

a pivot arm secured to said die block body, said pivot arm including a stripper segment having a first free end and a biasing segment having a second free end, said first free end of said pivot arm being adjacent said stitch tab cutting knife;

a pivot connection between said pivot arm and said die block body, said pivot connection separating said pivot arm into said stripper segment and said biasing segment; and biasing means engaging said die block body and said biasing segment said biasing means opposing movement of said stripper segment.

20. A stitch tab scrap stripper and die adapted for use in stripping stitch tab scraps from box blanks comprising:

a die block adapted to be secured to a male slotter head and having a die block body;

a stitch tab cutting knife mounted in said die block body;

a pivot arm secured to said die block body, said pivot arm including a stripper segment having a first free end and a biasing segment having a second free end;

box blank engaging means on said first free end of said pivot arm;

a pivot connection between said pivot arm and said die block body, said pivot connection separating said pivot arm into said stripper segment and said biasing segment; and biasing means engaging said die block body and said biasing segment, said biasing means opposing movement of said stripper segment.

* * * * *